United States Patent [19]

Hölzel

[11] Patent Number: 4,538,998

[45] Date of Patent: Sep. 3, 1985

[54] SWIMMING AND LIFE SAVING DEVICE

[76] Inventor: Bernd Hölzel, Robert-Bosch-Strasse 12, 6367 Karben 1, Fed. Rep. of Germany

[21] Appl. No.: 578,307

[22] Filed: Feb. 9, 1984

Related U.S. Application Data

[63] Continuation of Ser. No. 285,269, Jul. 20, 1981, abandoned.

[30] Foreign Application Priority Data

Aug. 16, 1980 [DE] Fed. Rep. of Germany ..... 3031019
May 8, 1981 [DE] Fed. Rep. of Germany ..... 3118184

[51] Int. Cl.[3] ..... B63C 9/10
[52] U.S. Cl. ..... 441/122; 441/81; 441/88
[58] Field of Search ..... 941/80, 81, 84, 88, 941/122, 123, 107

[56] References Cited

U.S. PATENT DOCUMENTS

| | | | |
|---|---|---|---|
| 1,043,367 | 11/1912 | Smack | 441/123 |
| 3,372,412 | 3/1968 | Robertson | 441/81 |
| 3,727,252 | 4/1973 | Bauermeister | 441/122 |
| 3,780,686 | 12/1973 | Brill | 114/267 |
| 3,820,179 | 6/1974 | Maertin | 441/122 |

FOREIGN PATENT DOCUMENTS

| | | | |
|---|---|---|---|
| 3031019 | 12/1983 | Fed. Rep. of Germany . | |
| 839941 | 4/1939 | France . | |
| 11782 | of 1904 | United Kingdom | 441/123 |
| 20630 | of 1914 | United Kingdom | 441/122 |

*Primary Examiner*—Trygve M. Blix
*Assistant Examiner*—Thomas J. Brahan
*Attorney, Agent, or Firm*—W. G. Fasse; D. H. Kane, Jr.

[57] ABSTRACT

The subject matter of the invention is a swimming and rescue aid having a disk shape for securing to the upper arm and comprising at least a one flat ring disk, the thickness of which is small relative to its outer diameter. The disk is elastic at least in the area of the arm or it comprises an arm passage opening having an elastic, expandible edge.

16 Claims, 7 Drawing Figures

Fig.1
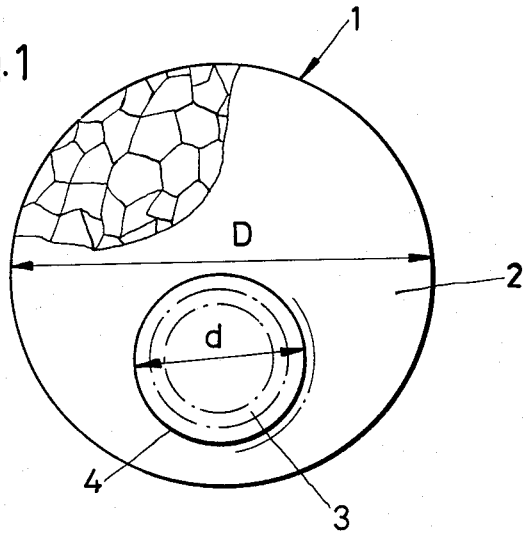
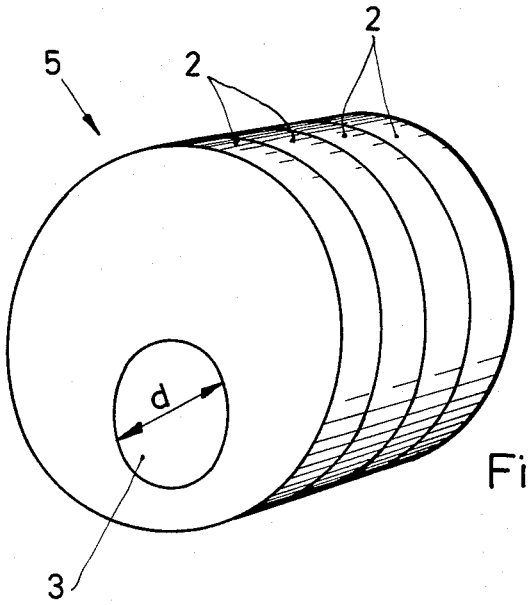
Fig.2

SWIMMING AND LIFE SAVING DEVICE

This is a continuation of application Ser. No. 285,269, filed July 20, 1981, now abandoned.

CROSS-REFERENCE TO RELATED APPLICATION

The present application is based on German Patent Applications No. P 3031019.1, filed in the Federal Republic of Germany on Aug. 16, 1980; and P 3118184.8, filed in the Federal Republic of Germany on May 8, 1981. The priority of the German filing dates is claimed for the present application.

BACKGROUND OF THE INVENTION

The invention relates to an annular swimming and rescue device. Swimming and rescue aids, particularly in the form of so-called arm wings are basically known and comprise an inflatable annular body which for example, may comprise two air chambers for safety reasons.

Further, these are known annular swimming aids made of styrofoam also to be secured to the upper arm.

OBJECTS OF THE INVENTION

In view of the above it is the aim of the invention to achieve the following objects singly or in combination.

It is the object of the invention to construct a swimming and rescue device or aid in such a manner that it may be conveniently attached and that it will sit comfortably on the upper arm during its use. Further, the device shall be instantaneously ready to use as it is attached and it shall not be able to get lost.

SUMMARY OF THE INVENTION

For achieving this objective the invention provides that the swimming and rescue aid or device comprises at least one flat ring disk, the thickness of which is small relative to its outer diameter and which is elastic at least in the arm zone.

The user reaches with his arms through the armhole, thereby expanding the edge thereof. The edge of the device rests elastically, yet firmly around the arm of the user, whereby the ring disk is safely and firmly held in position. Due to the holding force of the edge made of an elastical material an undesired slipping or an unintended loss of the swimming and rescue aid or device according to the invention is substantially impossible. Further, when the swimming and rescue aid is applied it sits instantly in a form locking manner around the upper arm without any need for the user to take further steps such as blowing up the swimming and resuce aid or device.

According to a preferred embodiment the edge of the arm opening is formed by an elastic insert which is glued into a hole in the ring disk or which is welded into position when a weldable material is used.

For achieving a small buoyancy the user applies but one swimming and rescue aid according to the invention to each arm. A correspondingly larger buoyancy is achieved by using respectively several swimming and rescue aids.

Further features of the invention are disclosed in the specification and in the claims in conjunction with the drawing.

BRIEF FIGURE DESCRIPTION

The invention will be described in more detail in the following with reference to example embodiments which are shown in the drawings, wherein:

FIG. 1 is a top plan view onto a swimming and rescue aid according to the invention;

FIG. 2 is a perspective view of a unit comprising several swim and rescue aids;

Figure 3:
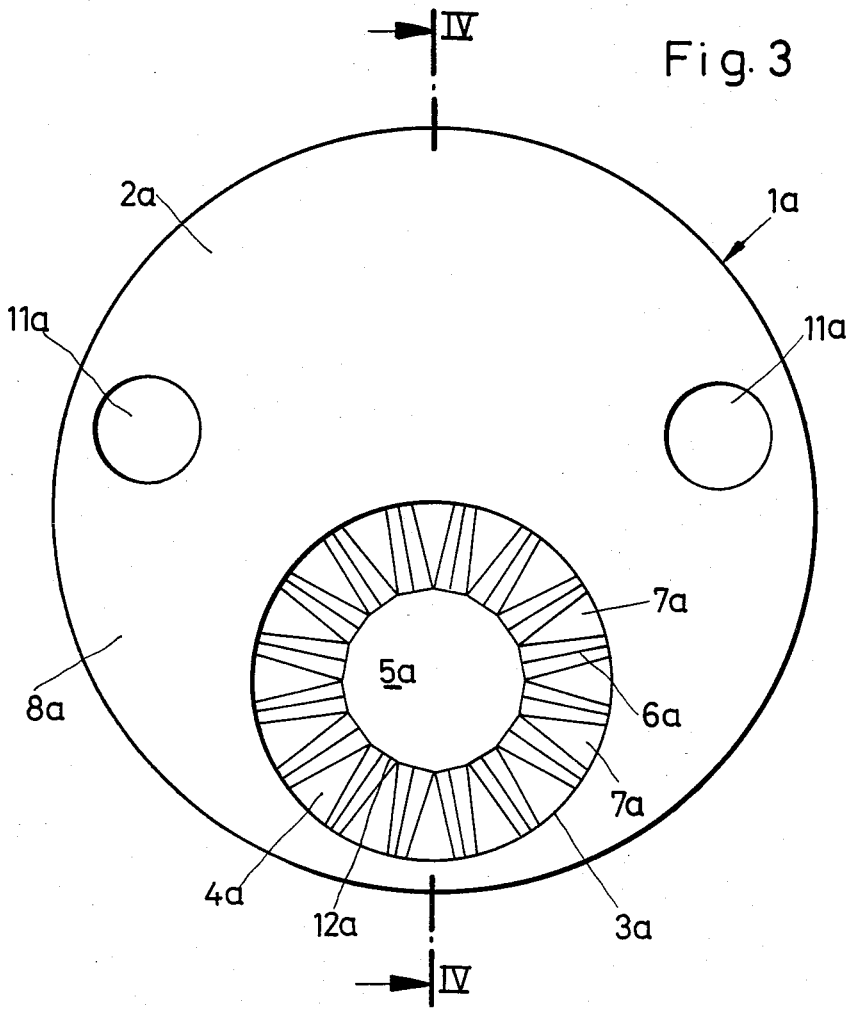
FIG. 3 is a top plan view of a modified embodiment.

DETAILED DESCRIPTION OF PREFERRED EXAMPLE EMBODIMENTS AND OF THE BEST MODE OF THE INVENTION

A swim and rescue device 1 according to the invention as shown in FIG. 1 comprises a buoyancy body in the form of a flat annular disk 2 having central axis and an outer diameter D substantially larger than its thickness or width B (see FIG. 4) as viewed in the axial direction. The ring disk 2 is provided with a hole or arm passage opening 3 having a clearance diameter D smaller than the arm cross-section of the user. At least the edge 4 or the edge zone 4 of the arm passage opening 3 of the ring or annular disk 2 is made of an elastic material so that the edge zone 4 will expand when the ring disk is applied so that the ring disk is provided with a safe and firm hold on the arm by a form-locking of the edge zone 4 around the user's arm.

The material for the ring disk is preferably a foamed, closed cell synthetic material which does not etch in contact with water. Particularly polyethylene satisfies these requirements. However, the invention is not limited to using this type of material.

Finally, the arm passage opening 3 in the circular, annular disk 2 is located off-center relative to said central axis.

The dimensions of the ring disks 2 may be varied for users of different weights or sizes. Basically however, two sizes are satisfactory, whereby the following dimensions have been found to be especially practical: an outer diameter D of 19 cm, a width B of 2 cm, and an arm passage opening 3 having a clearance cross-section d of about 4 to 9 cm.

FIG. 2 shows a swimming and rescue aid unit 5 comprising several ring disks 2. These ring disks 2 are pushed onto the arm together or individually until the desired buoyancy or lift is achieved.

Figure 4:
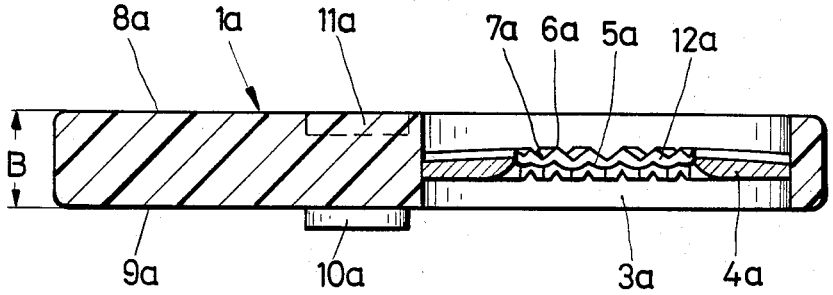
FIG. 4 is a sectional view along section line IV—IV in FIG. 3.

The example embodiment illustrated in FIGS. 3 and 4 is a swimming and rescue aid 1*a* which also comprises a flat ring disk 2*a* with a circular opening 3*a* arranged off center. The clearance cross-section of the opening 3*a*, however, is substantially larger than the arm cross-section of the user. An elastic insert 4*a* with an opening 5*a* is arranged in the opening 3*a*. The elastic insert 4*a* is flat at its bottom and slightly conical at its top as shown in FIG. 4. The insert 4*a* extends radially relative to the opening 3*a*. The opening 5*a* has a clearance which in turn is smaller than the arm cross section of the user.

At least the insert 4*a* shaped as a ring disk is made of an elastic material such as a synthetic material similar to rubber. The opening 5*a* in the ring shaped insert 4*a* may thus be widened when the user pulls the ring disk 2a over his arm while applying the disk.

The ring shaped insert 4a is zig-zag shaped or corrugated in the circumferential direction. Radially extending depressions 7a are arranged next to radially extending projections 6a. The elasticity of the insert 4a is increased with the aid of these depressions 7a and projections 6a. Further, as shown in FIG. 4 the insert 4a is slightly conical.

The ring disk 2a is flat and comprises parallel facing surfaces 8a and 9a provided with projections 10a and depressions 11a which serve for stacking or assembling. The free end of each projection 10a may be formed with a light ridge (see FIG. 6) and the depressions 11a may be provided with inwardly located cutbacks in order to provide a good hold for the projection 10a in the respective depression 11a.

The ring disks 2a are preferably also made of a material in the form of an elastic synthetic material. The thickness of the ring disk 2a is small relative to its diameter. The ratio of thickness to diameter is about 1 to 10.

The ring shaped insert 4a also comprises a thickness which is substantially smaller than its outer circumference. The thickness of the ring shaped and elastic insert 4a is also smaller than the thickness or material thickness of the ring disk 2a.

During the use the ring shaped insert 4a may deform itself, if required in such a manner that its inner edge 12a projects beyond one or the other facing surface 8a, 9a of the ring disk 2a.

Figure 5:
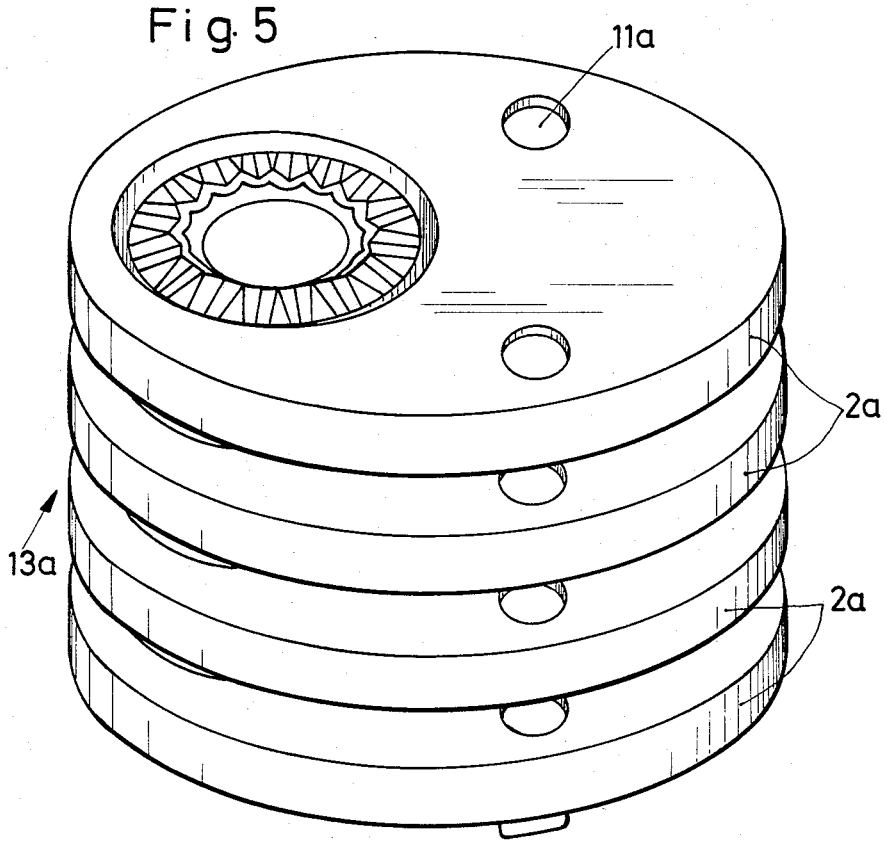
FIG. 5 is a perspective view of several swim and rescue aids according to FIG. 4.
Figure 6:
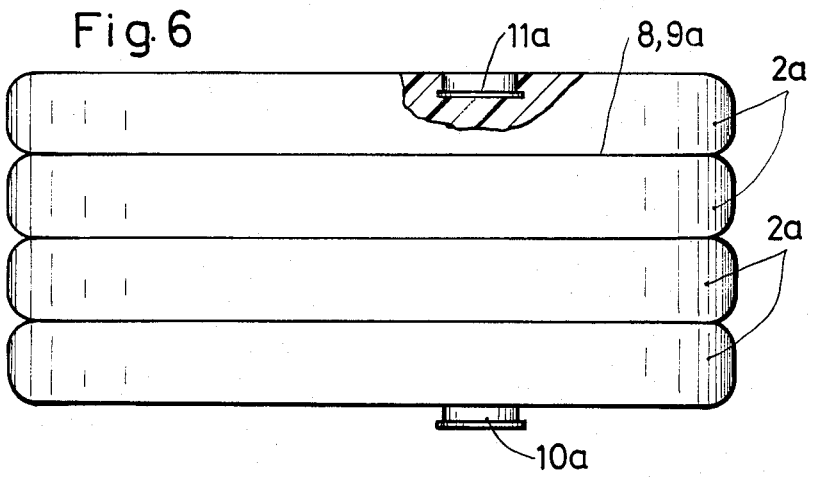
FIG. 6 is a side view partially rendered in section of a unit comprising several swim and rescue aids.

FIGS. 5 and 6 show a unit 13a comprising several swimming and rescue aids or ring disk 2a. The disk 2a may either be placed spaced from one another as shown in FIG. 5 or they may be interconnected through the projections 10a and recesses 11a when they are pushed over an arm. FIG. 6 shows that the recess 11a may have a groove 11b at its bottom and that the projection 10a has a flange 10b at its free end, said flange fitting into the groove.

Figure 7:
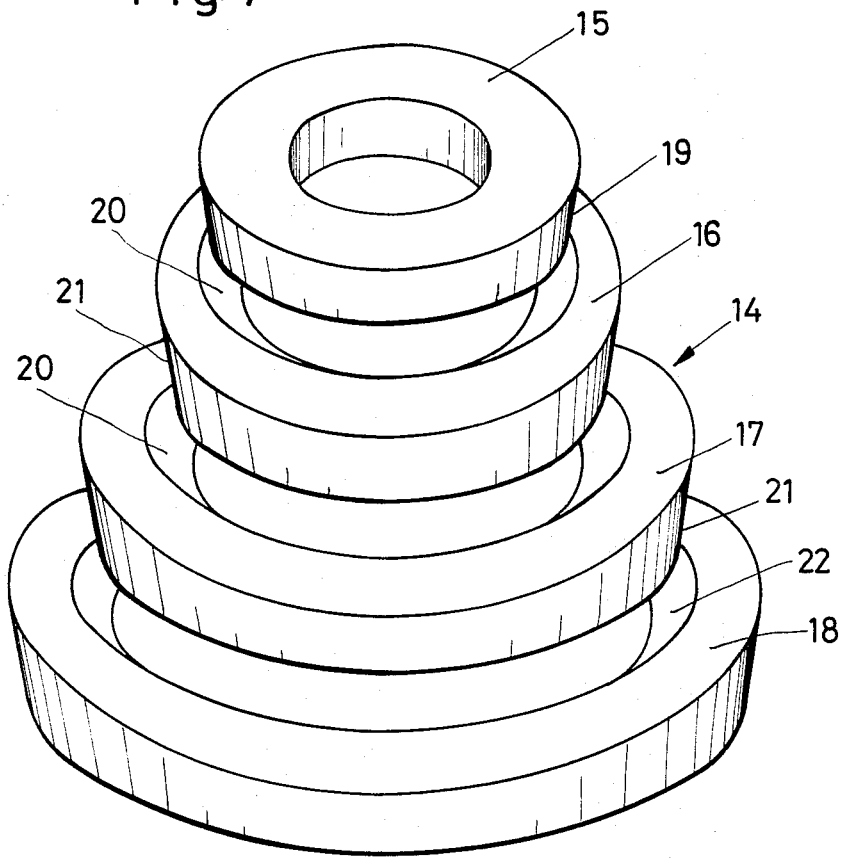
FIG. 7 is a perspective view of a further embodiment.

FIG. 7 illustrates a swimming and rescue aid comprising several ring bodies 15 to 18 which are adapted for nesting one in the other in the axial direction. The outer circumferential surface 19 of the ring body 15 having the smallest outer diameter, the inner ring surfaces 20 and the other circumferential surfaces 21 of all intermediate rings 16 and 17 as well as the inner ring surface 22 of the ring body 18 having the largest diameter are all conically inclined in the same direction so that the ring bodies 15 to 18 can be nested together only in one direction and can be taken apart also only in one direction. This feature makes sure that the rings cannot fall apart, for example, when the ring body 15 having the smallest diameter is carried on an arm in such a manner that the outer circumferential surface 19 tapers toward the body of the user.

I claim:

1. A swimming device, comprising at least one floatation disk made throughout its disk volume of floatation foam material for permanently maintaining its buoyancy independently of any inflation, an arm passage opening in said disk, said disk having a given diameter and a given thickness which is small relative to said given diameter, said arm passage opening having a diameter smaller than an arm diameter at the location where the device is held on an arm in use, said device further comprising an elastic edge zone (4) made of elastic foam material and surrounding said arm passage opening in said floatation disk, said elastic foam material of said edge zone (4) having an elasticity which is sufficient for permitting pushing a hand and an arm through said arm passage opening and for surrounding a user's arm in a form-locking manner for properly holding the device on an arm by said form-locking when a swimmer moves his arms.

2. The device of claim 1, wherein said disk and edge zone (4) are a single integral piece, said disk further comprising two side surfaces and attachment means forming part of said side surfaces for attaching a floatation disk to another similar floatation disk, said elastic edge zone, said attachment means and said floatation disk being all made of floatation foam material.

3. The device of claim 2, wherein said attachment means of said disk comprise projections on at least one disk side surface and depressions in at least another disk side surface so that the projections of one disk fit into the depressions of another disk in a set of disks.

4. The device of claim 3, wherein the projections (10a) have a small flange (10b) at the free end, and wherein the depressions are provided with an inwardly located groove (11b) for interlocking with a flange.

5. The device of claim 1, wherein said disk comprises a hole having a diameter larger than an arm, said elastic edge zone made of elastic foam material comprising an elastic ring type insert located in said hole around said arm passage opening having said diameter smaller than an arm.

6. The device of claim 5, wherein said elastic insert comprises radially extending projections (6a) and radially extending depressions (7a) forming said elastic form-locking edge.

7. The device of claim 5, wherein said elastic insert has a corrugated cross-sectional configuration.

8. The device of claim 5, wherein said elastic insert has a conical configuration at least on one of its surfaces.

9. The device of claim 5, wherein said disk comprises two side surfaces extending substantially in parallel to each other and spaced by said given thickness, and wherein said elastic ring type insert has a thickness smaller than said given thickness of the respective disk for extending in said hole intermediate said side surfaces.

10. The device of claim 5, wherein said disk comprises a central axis, said hole (3a) being located off-center relative to said central axis.

11. The device of claim 1, wherein said disk comprises a central axis, said arm passage opening being located off-center relative to said central axis.

12. The device of claim 1, comprising a plurality of said floatation disks forming a unit, each disk having its respective arm passage opening, and wherein the diameter of all arm passage openings is the same.

13. The device of claim 1, wherein said floatation foam material of said disk and said elastic foam material of said elastic edge zone are both a foamed, closed cell material which does not etch in contact with water.

14. The device of claim 1, wherein said floatation foam material of said disk and said elastic foam material of said elastic edge zone are both polyethylene.

15. A swimming device, comprising at least one floatation disk made of floatation material, an arm passage opening in said disk, said disk having a given diameter and a thickness which is small relative to said given diameter, said arm passage opening having a diameter smaller than an arm diameter at the location where the device is held on an arm in use, said device further comprising an elastic edge zone (4) surrounding said arm passage opening, said elastic edge zone (4) permitting the passage of an arm through said arm passage opening while also properly holding the device to an arm in a form-locking manner, said device further comprising attachment means for attaching a floatation disk to another similar floatation disk, said elastic edge zone (4), said attachment means, and said floatation disk being all made of suitable floatation material.

16. A swimming device, comprising at least one floatation disk made throughout its disk volume of floatation material for permanently maintaining its buoyancy independently of any inflation, an arm passage opening in said disk, said disk having a given diameter and a given thickness which is small relative to said given diameter, said arm passage opening having a diameter smaller than an arm diameter at the location where the device is held on an arm in use, said device further comprising an elastic edge zone (4) made of elastic foam material and surrounding said arm passage opening in said floatation disk, said elastic foam material of said edge zone (4) having an elasticity which is sufficient for permitting pushing a hand and an arm through said arm passage opening and for surrounding a user's arm in a form-locking manner, for properly holding the device on an arm by said form-locking during use.

* * * * *